US006522717B1

(12) United States Patent
Murakami et al.

(10) Patent No.: US 6,522,717 B1
(45) Date of Patent: Feb. 18, 2003

(54) REFLECTIVE-TYPE SOFT X-RAY MICROSCOPE

(75) Inventors: Katsuhiko Murakami, Kawasaki (JP); Hiroyuki Kondo, Tsukuba (JP)

(73) Assignee: Nikon Corporation, Tokyo (JP)

( * ) Notice: Subject to any disclaimer, the term of this patent is extended or adjusted under 35 U.S.C. 154(b) by 0 days.

(21) Appl. No.: 09/635,466

(22) Filed: Aug. 11, 2000

(30) Foreign Application Priority Data

Aug. 11, 1999 (JP) ..... 11-227005
Jun. 9, 2000 (JP) ..... 2000-173427

(51) Int. Cl.[7] ..... G21K 7/00
(52) U.S. Cl. ..... 378/43; 378/34; 378/70
(58) Field of Search ..... 378/43, 70, 71, 378/72, 76, 34, 35

(56) References Cited

U.S. PATENT DOCUMENTS 4,498,009 A * 2/1985 Reynolds ..... 250/492.1
5,022,064 A * 6/1991 Iketaki ..... 378/145
5,107,526 A * 4/1992 Hoover ..... 378/43
5,131,023 A * 7/1992 Yasugaki et al. ..... 378/43
5,177,774 A * 1/1993 Suckewer et al. ..... 378/43
5,199,057 A * 3/1993 Tamura et al. ..... 378/43
5,239,566 A * 8/1993 Nakamura et al. ..... 378/43
5,331,456 A * 7/1994 Horikawa ..... 359/350
5,569,916 A * 10/1996 Tomie ..... 250/287
5,619,382 A * 4/1997 Kato et al. ..... 359/858
5,737,137 A * 4/1998 Cohen et al. ..... 359/859
5,808,312 A * 9/1998 Fukuda ..... 250/492.2
6,162,577 A * 12/2000 Felter et al. ..... 430/270.1

OTHER PUBLICATIONS

Moonsuk Yi et al., "Characterization of EUVL Mask Defects By Actinic Detection of Far–Field Scattering Patterns", 1999, Proc. the 44th International Conference on Electron, Ion and Photon Beam Technology and Nanofabrication (EIPBN 2000) Palm Springs, CA, May 30–Jun. 2, 2000, pp. 91–92.

Tsuneyuki Haga et al., "At–Wavelenght EUVL Mask Inspection Using Mirau Interferometric Microscope", Proc. the 44th International Conference on Electron, Ion and Photon Beam Technology and Nanofabrication (EIPBN 2000) Palm Springs, CA, May 30–Jun. 2, 2000 pp. 293–294.

Seongtae Jeong et al., "At–wavelength Detection of Extreme Ultraviolet Lithography Mask Blank Defects", J. Vac. Sci. Technol. B 16(6), Nov./Dec. 1998, pp. 3430–3434.

* cited by examiner

*Primary Examiner*—Drew A. Dunn
*Assistant Examiner*—Allen C. Ho
(74) *Attorney, Agent, or Firm*—Morgan, Lewis & Bockius LLP

(57) ABSTRACT

A reflective-type soft X-ray microscope includes an image-focusing optical system including a concave mirror and a convex mirror, an illumination optical system that has a light source, a filter, and a focusing optical element for transmitting an illumination light beam, and a stage mechanism that carries and moves a sample under observation. In the reflective-type soft X-ray microscope, the concave mirror has at least one opening part for transmitting the illuminating light beam that illuminates the sample, and a reflected image of the sample is focused on a soft X-ray image detector by the image-focusing optical system.

42 Claims, 7 Drawing Sheets

REFLECTIVE-TYPE SOFT X-RAY MICROSCOPE

This application claims the benefit of Japanese Applications No. 11-227005, filed in Japan on Aug. 11, 1999, and No. 2000-173427, filed in Japan on Jun. 9, 2000, both of which are hereby incorporated by reference.

BACKGROUND OF THE INVENTION

1. Field of the Invention

The present invention relates to a reflective-type soft X-ray microscope in which reflected images of samples are observed using soft X-rays. The present invention also relates to a mask inspection device in which reflective masks used in soft X-ray reduction projection exposure are inspected for defects using the above-mentioned reflective-type soft X-ray microscope. In addition, the present invention relates to a reflective mask manufacturing method using the above-mentioned mask inspection device.

2. Discussion of the Related Art

In recent years, as semiconductor integrated circuit elements have become progressively smaller, reduction projection lithographic techniques using soft X-rays of an even shorter wavelength instead of the conventional ultraviolet light have been developed in order to improve the resolution of optical systems, which has been limited by the diffraction limit of light. Soft X-rays with a wavelength of 10 nm to 15 nm are used as the exposure light source in such techniques.

Since there are no available substances that are transparent in the aforementioned wavelength range, reflective masks have been used in soft X-ray reduction projection lithographic techniques instead of the conventional transmission-type masks. In such reflective masks, to reflect soft X-rays, a reflective film is formed of a multi-layer film on the surface of a substrate having sufficient mechanical strength and surface smoothness. A specified circuit pattern is formed on this reflective film by a layer formed of a substance that absorbs soft X-rays. In soft X-ray reduction projection exposure techniques, an image of the circuit pattern formed on the aforementioned reflective mask is focused on the wafer, which is coated with a photoresist, by means of a projection image-focusing optical system constructed of a plurality of optical elements, such as multi-layer film reflective mirrors, etc. The image is thus transferred to the photoresist on the wafer. Furthermore, since soft X-rays are attenuated by absorption in the atmosphere, the entire light path is maintained at a specified degree of vacuum.

Besides foreign objects adhering to the mask surface and defects in terms of external appearance such as missing portions and excess portions of the circuit pattern, defects in the aforementioned reflective mask include defects in the reflective film itself. As described above, the reflective film is a multi-layer film, and a high overall reflectivity can be obtained by aligning the phases of weak reflected light at the interfaces between the layers laminated in the multi-layer configuration. If local step differences are generated in the reflective film as a result of a bumpy surface profile of the substrate itself, which may exist prior to the formation of the aforementioned reflective film, and/or as a result of foreign objects accidentally incorporated during the process of lamination of the multi-layer film, etc., portions having deviations in periodic structures are formed. Consequently, the phase relationship of the light inside the reflective film is deviated from the design relationship at such portions, resulting in local decrease in reflectivity. Here, a phase difference of $2\pi$ corresponds to a used wavelength of 10 to 15 nm. Accordingly, local step differences on the order of nanometers cause the reflectivity defects. It has been extremely difficult to observe such extremely small step differences with microscopes using visible light or ultraviolet light, or with electron beam microscopes, etc.

If the actual exposure wavelength used in a soft X-ray reduction projection exposure apparatus is used, all defects, which are transferred to the photoresist on the wafer, can be detected. Thus, an inspection of such a reflective mask for defects should preferably be performed using the same wavelength as the exposure wavelength. Consequently, it is necessary to use a reflective-type soft X-ray microscope in order to inspect a reflective mask for defects.

Transmission-type microscopes and reflective microscopes exist for soft X-ray microscopes. In the reflective-type soft X-ray microscopes, Schwarzschild optical systems are widely used. As shown in FIG. 4, a Schwarzschild optical system is an optical system that generally is formed of two spherical-surface mirrors with concentric spherical surfaces, i.e., a concave mirror 2 and a convex mirror 1. A hole 7 that allows light to pass through is formed in the center of the concave mirror 2. In cases where such an optical system is used in the soft X-ray region as described above, the reflective surfaces are coated with a multi-layer film coating that reflects soft X-rays.

Conventionally, in order to construct a reflective-type microscope using such a Schwarzschild optical system, as shown in FIG. 4, it has been necessary to incline the normal of sample 3 with respect to the optical axis 0 (the central axis of rotation of the optical system) so that mechanical interference of illuminating light beam 5 and optical system mirror tube 19 is prevented. Furthermore, when the sample is inclined relative to the optical axis 0, the visual field that can be observed is limited by the depth of focus of the optical system.

It is known that the diffraction-limit resolution (R) and depth of focus (DOF) of the optical system are determined by the numerical aperture (NA) and wavelength ($\lambda$), and are given by the following equations:

$$R=0.61\ \lambda/NA$$

$$DOF=\lambda/NA^2$$

For example, if a resolution of 70 nm is to be obtained with a light source having a wavelength of 13 nm, NA is 0.11, and the depth of focus (DOF) in this case is approximately 1 $\mu$m. Here, if the sample is inclined 45°, the width of the visual field limited by the depth of focus is a mere 1.4 $\mu$m. If the sample is installed perpendicular to the optical axis, a visual field of at least several tens of microns can be ensured, although this also depends on the dimensions and magnification of the optical system.

Imaging is also accomplished to some extent even in the regions outside the visual field limited by the depth of focus; however, since blurring of the image is severe, the diffraction-limit resolution cannot be obtained. For example, an experiment performed with a soft X-ray microscope using a Schwarzschild optical system with such an inclined sample arrangement has been reported in Optics Letters, Vol. 17, (1992) p. 157. In this experiment, an image of only about #200 mesh (pitch: 127 $\mu$m) was visible, so that the results did not even remotely approach the resolution (0.1 $\mu$m) expected from the wavelength (18.2 nm) and NA (0.1) of the optical system.

SUMMARY OF THE INVENTION

Accordingly, the present invention is directed to a reflective-type soft X-ray microscope that substantially obviates the problems due to limitations and disadvantages of the related art.

An object of the present invention is to provide a reflective-type soft X-ray microscope which makes it possible to observe images with the sample installed perpendicular to the optical axis and with a reflective-type arrangement, using an image-focusing system consisting of a concave mirror and a convex mirror, as typified by a Schwarzschild optical system.

Another object of the present invention is to provide a defect inspection device for reflective masks used in soft X-ray reduction projection exposure, which uses such a soft X-ray microscope.

Additional features and advantages of the invention will be set forth in the description that follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the present invention provides, in a first aspect, the reflective-type soft X-ray microscope including an image-focusing optical system formed of a concave mirror and a convex mirror; an illumination optical system that has a light source, a filter and a focusing optical element; and a stage mechanism that carries and moves the observation sample, wherein at least one opening part that is used to transmit the illuminating light beam illuminating the sample is formed in the aforementioned concave mirror, and a reflected image of the sample is focused on a soft X-ray image detector by the above-mentioned image-focusing optical system.

In a second aspect, the present invention provides the reflective-type soft X-ray microscope having the features of the first aspect wherein the surface of the sample is positioned to be substantially perpendicular to the optical axis of the aforementioned image-focusing optical system.

In a third aspect, the present invention provides the reflective-type soft X-ray microscope of the invention having the features of the first or second aspect above, wherein in the concave mirror constituting the image-focusing optical system, a diaphragm is installed in the position on which the illuminating light beam that has passed through the aforementioned opening part is incident after being reflected by the sample.

In a fourth aspect, the present invention provides the reflective-type soft X-ray microscope having the features of the third aspect, wherein the diaphragm is formed by forming a light-blocking film on the reflective film formed on the surface of the aforementioned concave mirror, while leaving an opening part that acts as a diaphragm.

In a fifth aspect, the present invention provides the reflective-type soft X-ray microscope having the features of the third aspect above, wherein the aforementioned diaphragm is formed by forming a reflective film only in the opening part that acts as said diaphragm.

In a sixth aspect, the present invention provides the reflective-type soft X-ray microscope having the features of the third aspect above, wherein the aforementioned diaphragm is disposed between the aforementioned sample and the surface of the aforementioned concave mirror, and is formed by a substrate formed of a light-blocking material or a substrate covered by a light-blocking material, which has an opening part that acts as a diaphragm.

In a seventh aspect, the present invention provides the reflective-type soft X-ray microscope having the features of any one of the first through sixth aspects above, wherein the supporting columns that support the convex mirror constituting the aforementioned image-focusing optical system are disposed so that neither the illuminating light beam that illuminates the sample nor the reflected light beam that is reflected by the sample is blocked by said supporting columns.

In an eighth aspect, the present invention provides the reflective-type soft X-ray microscope including an image-focusing optical system including a concave mirror and a convex mirror; an illumination optical system that has a light source, a filter and a focusing optical element; and a stage mechanism that carries and moves the observation sample, wherein at least one opening part that is used to transmit the illuminating light beam illuminating the sample is formed in the aforementioned concave mirror, and an image formed by scattered light or diffracted light is focused on a soft X-ray image detector by the above-mentioned image-focusing optical system.

In a ninth aspect, the present invention provides the reflective-type soft X-ray microscope having the features of the eighth aspect above, wherein the surface of the sample is positioned to be substantially perpendicular to the optical axis of the aforementioned image-focusing optical system.

In a tenth aspect, the present invention provides the reflective-type soft X-ray microscope having the features of the eighth or ninth aspect above, wherein in the concave mirror that constitutes the image-focusing optical system, a reflective film is formed on the surface of the aforementioned concave mirror, and a light-blocking film is formed by means of a substance that absorbs the reflected light beam only in the position on which the illuminating light beam that has passed through the aforementioned opening part is incident after being reflected by the sample.

In an eleventh aspect, the present invention provides the reflective-type soft X-ray microscope having the features of the eighth or ninth aspect above, wherein in the concave mirror that constitutes the image-focusing optical system, a reflective film is formed on the mirror except in the position on which the illuminating light beam that has passed through the aforementioned opening part is incident after being reflected by the sample.

In a twelfth aspect, the present invention provides the reflective-type soft X-ray microscope having the features of the eighth or ninth aspect above, wherein in the image-focusing optical system, a substrate including a light-blocking material or a substrate covered by a light-blocking material, which blocks the reflected light beam from the aforementioned sample, is disposed between the aforementioned concave mirror and the aforementioned sample.

In a thirteenth aspect, the present invention provides the reflective-type soft X-ray microscope having the features of any one of the eight through twelfth aspects above, wherein a supporting columns that support the convex mirror constituting the image-focusing optical system are disposed so that the illuminating light beam that illuminates the sample is not blocked.

In a fourteenth aspect, the present invention provides the reflective-type soft X-ray microscope having the features of any one of the first through thirteenth aspects above, wherein the illumination optical system includes a light source of one of a laser plasma light source, a discharge plasma light source, and an X-ray laser light source, a filter that selectively transmits soft X-rays of a specified wavelength, and a focusing optical element that focuses the light beam emitted from the light source.

In a fifteenth aspect, the present invention provides the reflective-type soft X-ray microscope having the features of any one of the first through fourteenth aspects above, wherein the illumination optical system includes a selector that switches the illuminating light to soft X-rays, visible light or ultraviolet light.

In a sixteenth aspect, the present invention provides the reflective-type soft X-ray microscope having the features of any one of the first through fifteenth aspects above, wherein a plurality of the aforementioned illumination optical systems are installed, and a plurality of illuminating light beams that have different wavelengths are respectively caused to be incident on the sample via a plurality of different opening parts formed in the concave mirror constituting the aforementioned image-focusing optical system.

In a seventeenth aspect, the present invention provides the reflective-type soft X-ray microscope having the features of any one of the first through sixteenth aspects above, wherein the image-focusing optical system is a Schwarzschild optical system.

In an eighteenth aspect, the present invention provides a mask inspection device for inspecting a reflective mask to be used in a soft X-ray reduction projection exposure by the reflective-type soft X-ray microscope having the features of any one of the first through seventeenth aspects above, using soft X-rays of a wavelength used in the soft X-ray reduction projection exposure.

In a nineteenth aspect, the present invention provides the mask inspection device having the features of the eighteenth aspect above, wherein the surface of the sample is scanned while the intensity of reflected light, diffracted light or scattered light is detected, and an image is acquired in the area where the detected intensity varies.

In a twentieth aspect, the present invention provides a mask manufacturing method for forming a pattern on a substrate to manufacture a reflective mask, the method including at least a first process in which a reflective film which has a multi-layer film that reflects soft X-rays is formed on the surface of a substrate; a second process in which a light-blocking film that absorbs soft X-rays is formed on the surface of the aforementioned reflective film; a third process in which a resist layer is further formed on the surface of the aforementioned light-blocking film; a fourth process in which a desired reflective or light-blocking pattern is exposed on the resist layer; a fifth process in which the aforementioned pattern is formed by developing the aforementioned resist layer; and a sixth process in which the aforementioned light-blocking film is etched with the aforementioned developed resist layer used as a protective film, wherein in at least one of the first process in which a reflective film is formed on the substrate, the fifth process in which a reflective or light-blocking pattern is formed by developing the resist layer, and the sixth process in which the aforementioned pattern is formed by etching the light-blocking film, work is included in which an inspection is made for phase defects in the multi-layer film that forms the aforementioned reflective film, foreign objects on the surface of said multi-layer film, or defects in the resist layer or in the reflective or light-blocking pattern formed on the reflective mask, using the mask inspection device of the nineteenth aspect above.

In a twenty-first aspect, the present invention provides a mask manufacturing method for forming a pattern on a substrate to manufacture a reflective mask, including at least a first process in which a reflective film which has a multi-layer film that reflects soft X-rays is formed on the surface of a substrate; a second process in which a resist layer is formed on the aforementioned reflective film; a third process in which a reflective or light-blocking pattern is exposed on the aforementioned resist layer; a fourth process in which the aforementioned pattern is formed by developing the aforementioned resist layer; and a fifth process in which a light-blocking film consisting of an inorganic compound, an organic compound or an organic-inorganic compound that absorbs soft X-rays is formed in the areas not covered by the aforementioned developed resist layer, with said resist layer used as a protective layer, wherein in at least one of the first process in which a reflective film is formed on the substrate, the fourth process in which a reflective or anti-reflective pattern is formed by developing the resist layer and the fifth process in which a light-blocking film is formed in the form of the aforementioned pattern, work is included in which an inspection is made for phase defects in the multi-layer film that forms the aforementioned reflective film, foreign matter on the surface of said multi-layer film, or defects in the resist layer or in the reflective or light-blocking pattern formed on the reflective mask, using the mask inspection device of the nineteenth aspect above.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
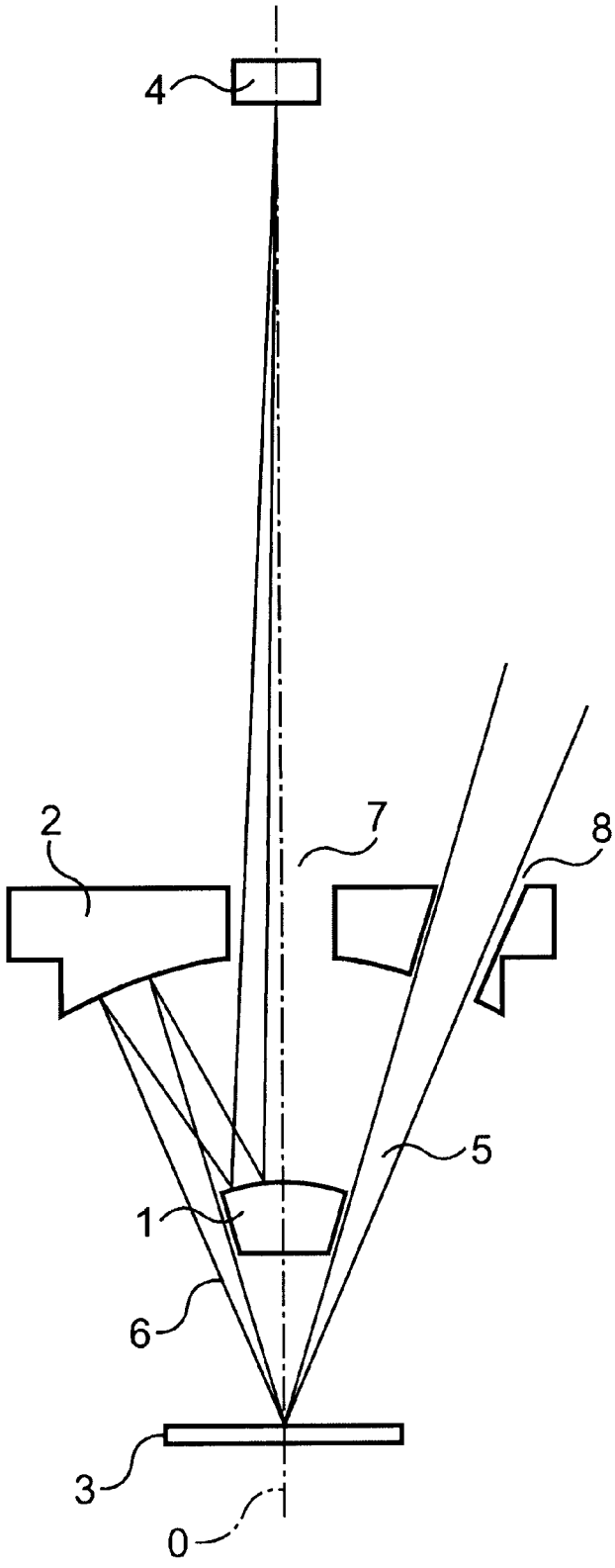
FIG. 1 is a diagram which illustrates the principle of the reflective-type soft X-ray microscope according to a preferred embodiment of the present invention.

FIG. 1 is a schematic diagram which illustrates the principle of the reflective-type soft X-ray microscope of the present invention.

Figure 4:
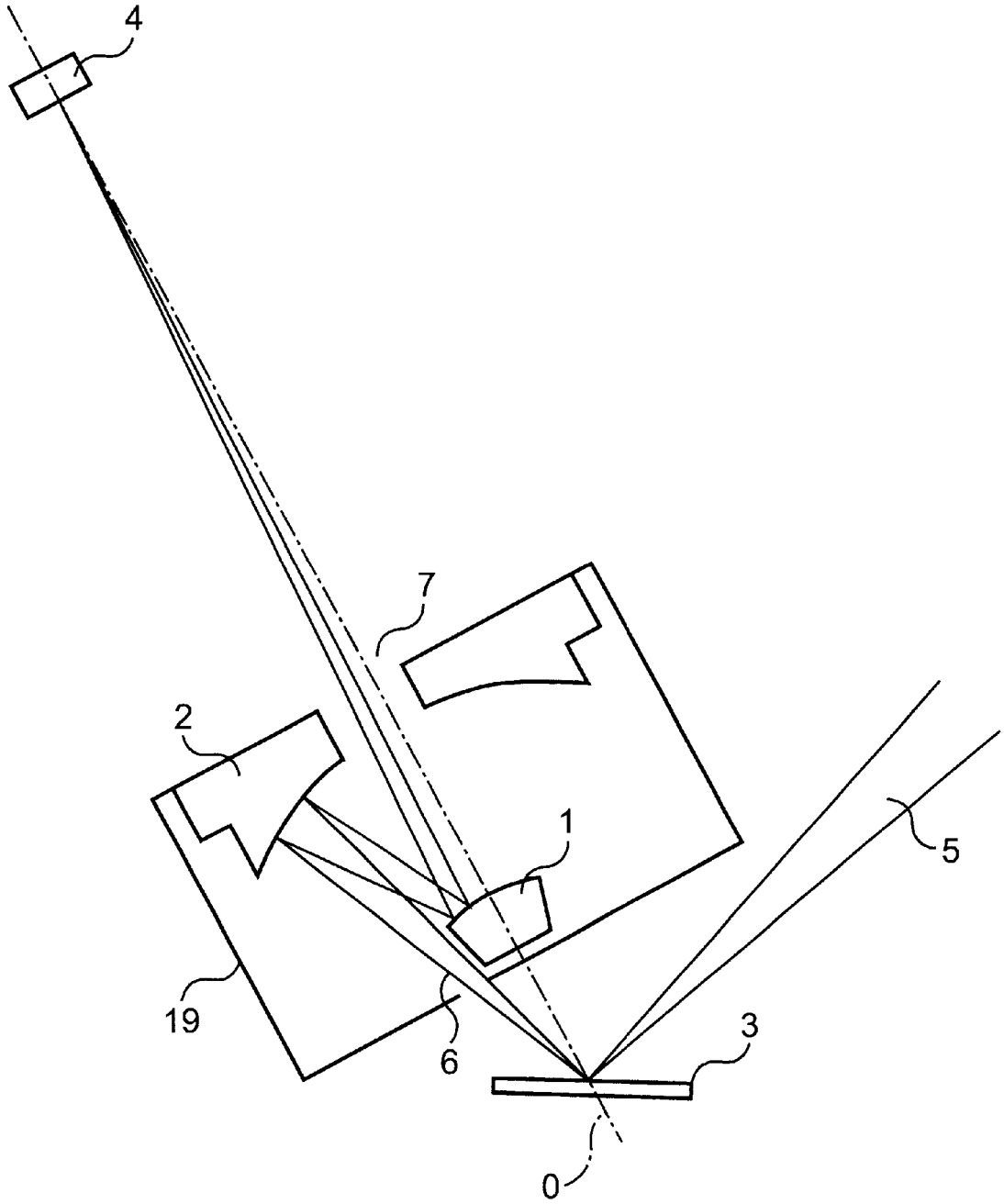
FIG. 4 is a schematic diagram of a conventional reflective-type soft X-ray microscope.

The reflective-type soft X-ray microscope of the present invention is equipped with a convex mirror 1 and concave mirror 2 that constitute an image-focusing optical system, and an image detector 4. As shown in FIG. 1, an opening part 8 that is used to prevent the illuminating light 5 from being blocked by the optical system is formed in the concave mirror 2, and the sample 3 is positioned so that its surface is perpendicular to the optical axis 0 of the image-focusing optical system. As a result of the adoption of the aforementioned arrangement, a reflected image of the sample 3 can be observed without inclining the sample 3 contrary to the conventional reflective-type soft X-ray microscope shown in FIG. 4.

Here, the illuminating light 5 passes through the aforementioned opening part 8, and is reflected by the sample (reflective mask) 3, so that this light becomes reflected light 6, which is directed towards the concave mirror 2. Since the illuminating light 5 and reflected light 6 reflected by the sample 3 pass through positions that are symmetrical with respect to the optical axis 0, the respective light beams are not blocked by the convex mirror 1. The reflected light 6 reflected by the surface of the sample 3 is further reflected by the concave mirror 2 and convex mirror 1, then passes through the opening part 7 formed in the center of the concave mirror 2, and is focused as an image on the image detector 4.

Reflective films with a multi-layer structure are formed on the reflective surfaces of the convex mirror 1 and concave mirror 2 in order to reflect soft X-rays of a specified wavelength. For example, a multi-layer film in which Mo (molybdenum) and Si (silicon) are alternately laminated, a multi-layer film in which Mo and SiC (silicon carbide) are alternately laminated, or a multi-layer film in which Ru (ruthenium) and Si are alternately laminated, etc., may be used.

Figure 2:
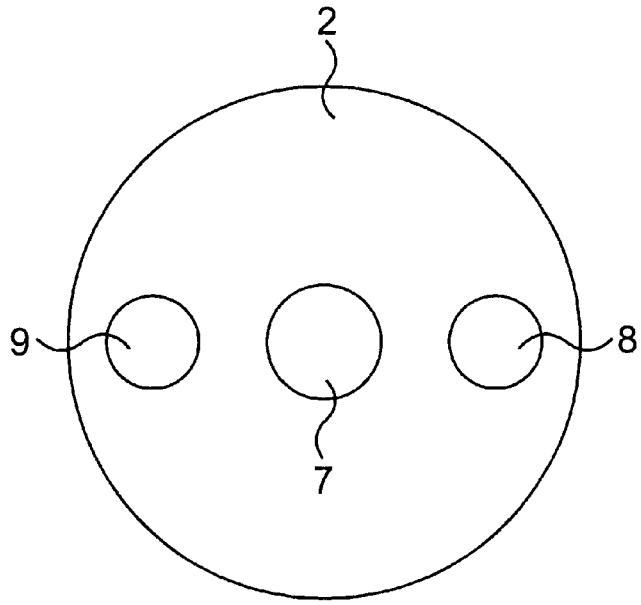
FIG. 2 is a diagram which shows the concave mirror of the Schwarzschild optical system used in a preferred embodiment of the present invention.

Furthermore, as is shown in FIG. 2, an opening part 8 which allows the illuminating light 5 to pass through, a diaphragm 9 which determines the numerical aperture (NA) of the image-focusing optical system, and an opening part 7 which allows the reflected light that is reflected by the convex mirror 1 to pass through, are formed in the concave mirror 2. The opening part 8 (which allows the illuminating light 5 to pass through) and the diaphragm 9 are disposed in symmetrical positions with respect to the optical axis 0 (i.e., the center of the concave mirror 2). The diaphragm 9 is constituted by the aforementioned multi-layer reflective film. As described in the fourth aspect of the present invention above, the diaphragm 9 may be constructed by forming the aforementioned multi-layer reflective film on the entire surface of the concave mirror 2, and then forming a light-blocking film, such as an Mo thin film, etc., on the reflective film except the area corresponding to the diaphragm. Alternatively, the diaphragm 9 may be formed only at the portion that corresponds to the diaphragm opening part as described in the fifth aspect above (soft X-rays cannot be reflected by a substrate surface on which no reflective film is formed). Also, as described in the sixth aspect above, it is possible to install a substrate formed of a light-blocking material or a substrate covered by a light-blocking material, which is equipped with an opening part that acts as a diaphragm, in the light path between the sample 3 and the concave mirror 2 having the multi-layer reflective film formed thereon. As a result of such a construction, a reflected image from the sample can be detected.

Figure 3:
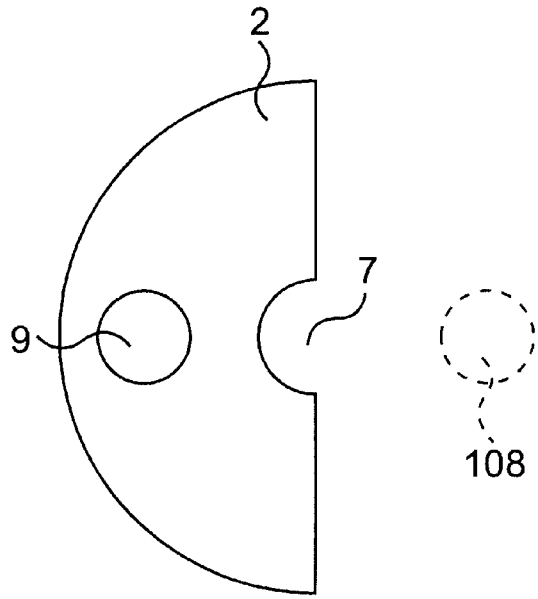
FIG. 3 is a diagram which shows the concave mirror of the Schwarzschild optical system used in a preferred embodiment of the present invention.

The opening part 8 in the concave mirror 2, which allows the illuminating light 5 to pass through, may have any shape as long as this opening part can be formed so that the illuminating light 5 is not blocked. For example, as is shown in FIG. 3, the concave mirror 2 may be formed with a semicircular shape, and a region 108 through which the illuminating light 5 passes may be located in the removed half of the semicircular mirror 2.

Furthermore, in cases where the sample 3 is observed as a dark-field image, a light-blocking member for blocking the reflected light 6 reflected from the surface of the sample 3 may be installed between the sample 3 and the concave mirror 2, as described in the twelfth aspect above. As a result of the installation of such a light-blocking member, the reflected light 6 is cut off, so that an image based on scattered light or diffracted light from the sample 3 can be detected by the image detector 4. Here, it is sufficient to have a construction in which the reflected light 6 does not contribute to imaging. Thus, instead of installing a light-blocking member in the light path as described above, the dark-field imaging can be achieved by forming a multi-layer reflective film on the entire surface of the concave mirror 2, and by forming a light-blocking film from a substance that absorbs the reflected light 6 (and does not reflect this light) only on the portion receiving the reflected light 6 (the tenth aspect above). Alternatively, the multi-layer reflective film on the concave mirror 2 may be removed only from the portion of the mirror 2 that receives the reflected light 6 (the eleventh aspect above).

As the image detector 4, a CCD (charge-coupled device), an MCP (micro-channel plate), an X-ray film, or a radiation image conversion panel using a fluorescent screen, etc., which is sensitive to soft X-rays, can be used. Also, a zooming tube (manufactured by Hamamatsu Photonics K.K.), which converts the soft X-ray image into an electronic image through a photoelectric conversion surface, and displays the image on a fluorescent surface after enlarging the image by an electronic lens, may be used. In cases where a zooming tube is used, the image can be magnified. Thus, the magnification of the image-focusing optical system need not be large. Furthermore, the zooming tube can provide observations with varying magnification rates.

Thus, in the present invention, observation of a bright-field image based on reflected light and observation of a dark-field image based on scattered light or diffracted light are possible. Thus, in inspecting reflective masks, a bright-field image can be used for inspecting phase defects in the multi-layer film or defects in the reflective or light-blocking pattern, etc., and a dark-field image can be used for inspecting foreign objects in the multi-layer film or resist layer, etc.

Figure 8:
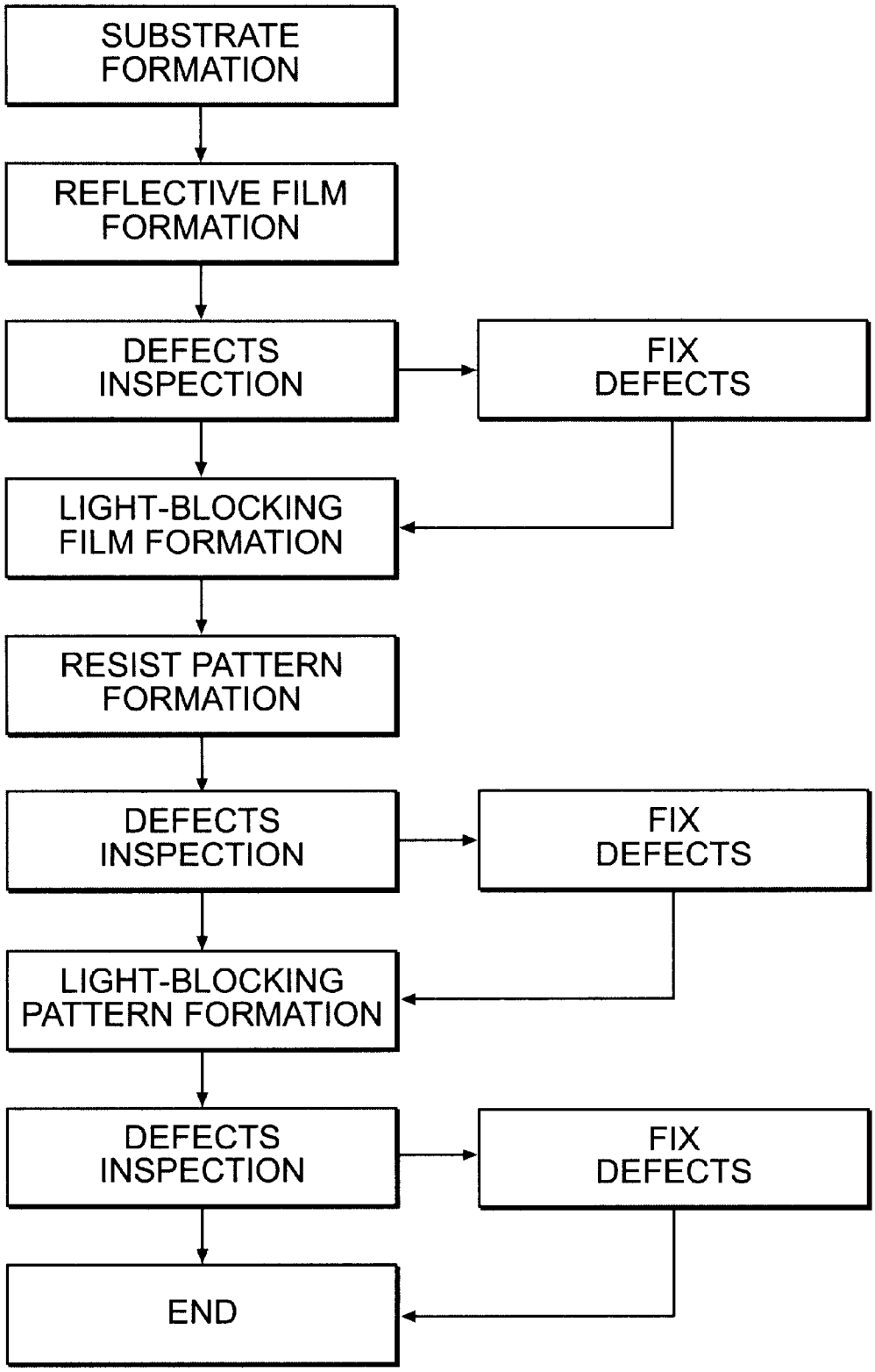
FIG. 8 is a flow chart illustrating a reflective mask manufacturing process according to a preferred embodiment of the present invention.

Next, a reflective mask manufacturing process using a reflective-type soft X-ray microscope-type mask defect inspection device constructed according to the present invention is shown in FIG. 8.

First, a substrate formed of a low-thermal-expansion glass is worked to a specified shape and dimensions. The surface of this substrate is polished to a specified flatness and surface roughness. Thus, a multi-layer film formed of Mo/Si, etc., which reflects soft X-rays of a specified wavelength, is formed on the surface of the substrate. The multi-layer film is formed by a thin film formation method, such as sputtering or vacuum evaporation, etc. However, defects may be generated as a result of scratching of the substrate surface, incorporation of foreign objects before or during film formation, and/or as a result of the adhesion of foreign objects following film formation, etc. Accordingly, an inspection for defects is performed using the bright-field image and dark-field image mask inspection device of the present invention. If the defects are fixable, an appropriate correction is made.

For example, in the case of defects caused by scratching of the substrate surface or incorporation of foreign objects before or during film formation, if the defects are within a predetermined tolerance, surface smoothing can be accomplished by forming an additional multi-layer film on the surface of the already-formed thin film. Furthermore, in the case of the adhesion of foreign objects following film formation, the foreign objects can be physically removed by ultrasonic cleaning, etc.

Next, a light-blocking film of Cr, TiN, NiSi, Ti, Ta, TaN, TaSiN or Al, etc., is formed on the surface of the reflective film by a thin film formation method such as sputtering, etc.

Furthermore, a photoresist is applied as a coating to the surface of the light-blocking film, and a specified pattern is exposed by an electron beam image-drawing apparatus, etc. This pattern is then developed so that a resist pattern is formed. In this case, there is a possibility that defects, such as missing portions or excess portions of the resist pattern, will be generated. Accordingly, an inspection for such defects is performed using the mask inspection device of the present invention in the bright-field image mode. If defects of excess portions of the resist pattern are present, such defects can be corrected by selectively removing the portions of the resist pattern by irradiating the resist pattern with a focused energy beam, such as a laser beam, electron beam or ion beam, etc. Furthermore, in cases where defects of missing portions of the resist pattern are present, an organic thin film can be selectively formed by supplying hydrogen carbide gas to the locations of the defects so that a hydrogen carbide gas atmosphere is formed, and irradiating these locations with the aforementioned focused energy beam.

Finally, a light-blocking pattern is formed by selectively etching and removing the light-blocking film by a etching method, such as dry etching, etc., using the resist pattern as a mask. In this case as well, defects such as missing portions and excess portions of the light-blocking pattern may occur. Accordingly, an inspection for defects is performed using the mask defect inspection device of the present invention in the bright-field image mode. Here, if there are defects in the light-blocking pattern, such defects are corrected using a focused ion beam of Ga, etc. In cases where the defects are excess portions of the light-blocking pattern, these excess portions can be selectively removed by irradiation with the aforementioned ion beam. If necessary in this case (depending on the-type of light-blocking film involved), excess portions can be selectively removed by supplying a fluorine-type reaction gas to the vicinity of the defects and irradiating the defects with the aforementioned ion beam. Furthermore, in cases where the defects are missing portions of the light-blocking pattern, a light-blocking film can be partially formed by selecting $WF_6$, etc., as a reaction gas, and irradiating the defects with an ion beam in an atmosphere of this gas. This completes the manufacture of reflective masks for use in soft X-ray reduction projection exposure.

Figure 9:
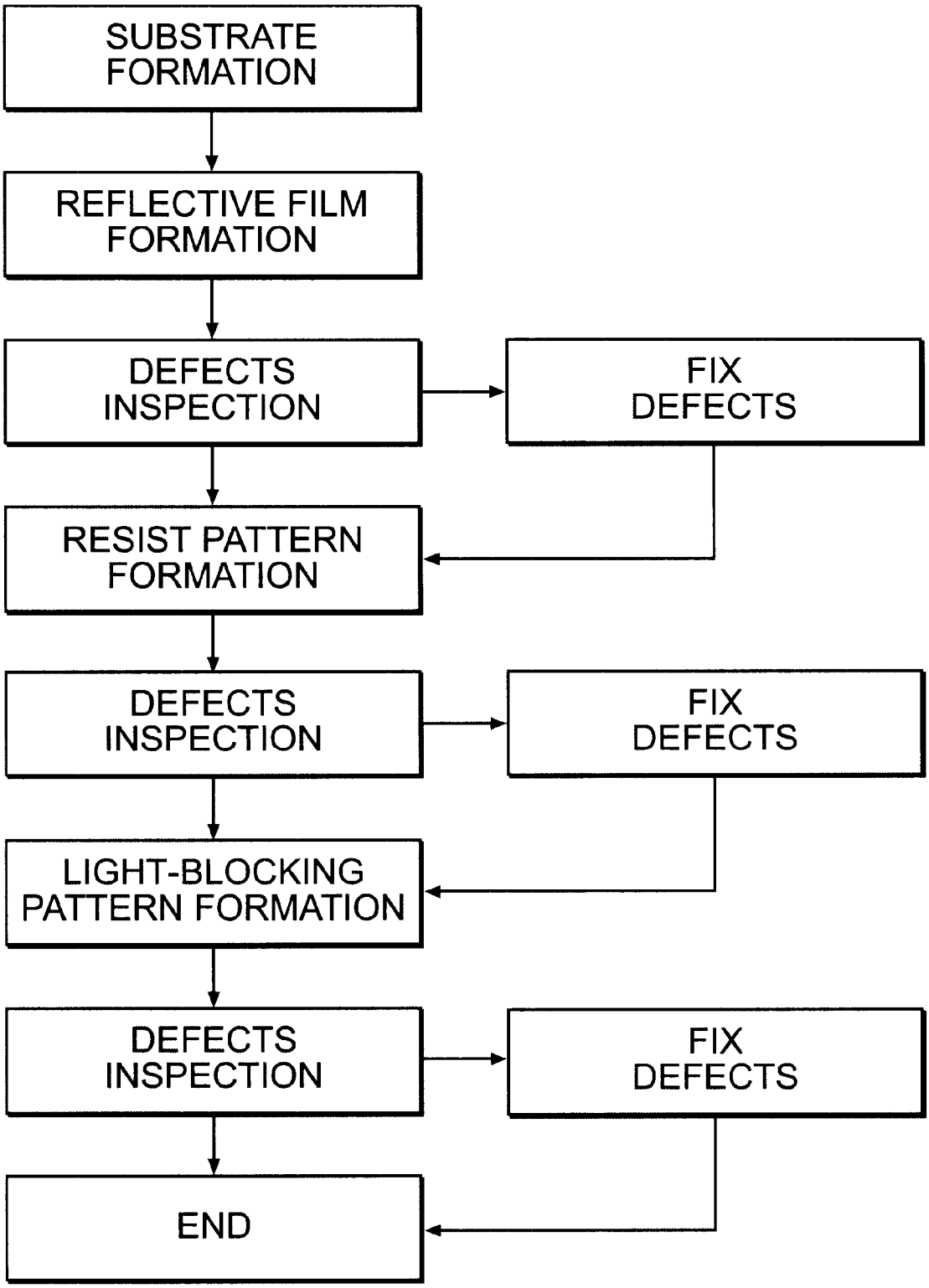
FIG. 9 is a flow chart illustrating a reflective mask manufacturing process according to another preferred embodiment of the present invention.

Furthermore, another reflective mask manufacturing process using the reflective-type soft X-ray microscope-type mask defect inspection device of the present invention is shown in FIG. 9.

First, a substrate formed of a low-thermal-expansion glass is worked to a specified shape and dimensions. The surface of this substrate is polished to a specified flatness and surface roughness. Next, a reflective film consisting of Mo/Si, etc., which reflects soft X-rays of a specified wavelength, is formed on the surface of the substrate. This reflective film is formed by a thin film formation method, such as sputtering or vacuum evaporation, etc. However, defects may be generated as a result of scratching of the substrate surface, incorporation of foreign objects before or during film formation, and/or as a result of the adhesion of foreign objects following film formation, etc. Accordingly, an inspection for defects is performed using the bright-field image and/or dark-field image mask inspection device of the present invention. If the defects are repairable, an appropriate correction is made in the same manner as described above.

Furthermore, a photoresist is applied as a coating to the surface of the aforementioned reflective film, and a specified pattern is exposed by an electron beam image-drawing apparatus, etc. This pattern is then developed so that a resist pattern is formed. In this case, there is a possibility that defects such as missing portions or excess portions of the resist pattern will be generated. Accordingly, an inspection for such defects is performed using the mask inspection device of the present invention in the bright-field image mode. If defects are present here, an appropriate correction is made in the same manner as described above.

Finally, using the resist pattern as a casting mold, a light-blocking film consisting of Ni, etc., is selectively formed by a plating method, so that a light-blocking pattern is formed. In this case as well, defects, such as missing portions and excess portions of the light-blocking pattern, may occur. Accordingly, an inspection for defects is performed using the mask defect inspection device of the present invention in the bright-field image mode. Here, if defects are present, an appropriate correction is made in the same manner as described above. This completes the manufacture of reflective masks for use in soft X-ray reduction projection exposure.

WORKING EXAMPLES

Figure 5:
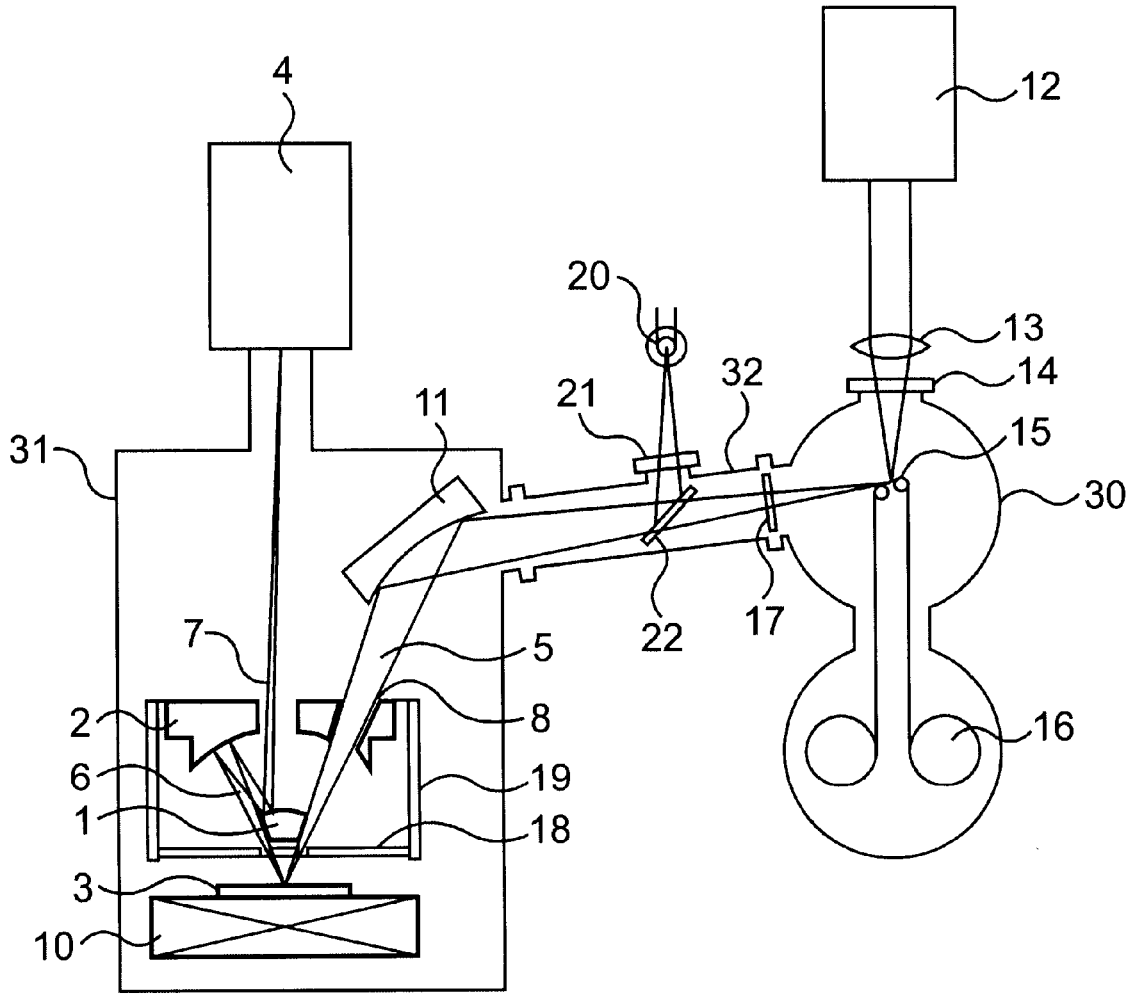
FIG. 5 is a schematic structural diagram of a reflective-type soft X-ray microscope according to a working example of the present invention.

FIG. 5 schematically shows a structure of a reflective-type X-ray microscope according to a working example of the present invention.

The reflective-type X-ray microscope is equipped with an image-focusing optical system constructed of a Schwarzschild optical system including a concave mirror 2 and a concave mirror 1, which have concentric spherical surface shapes, and an illumination optical system which has a laser plasma light source that generates soft X-rays, a filter 17, and a focusing reflective mirror 11. The reflective-type X-ray microscope also includes a sample stage 10, which carries and moves the observation sample 3, and an image detector 4. The convex mirror 1 is supported by supporting columns 18.

In the laser plasma light source, pulsed laser light with a wavelength of 1.06 $\mu$m generated by an Nd:YAG laser light source 12 is focused through a lens 13, and is directed via a window 14 towards a target installed inside a first vacuum chamber 30 to generate a plasma 15. In this way, soft X-rays are generated.

A tape target made of Ta (tantalum) is used as the target. This target is continuously supplied by a tape target continuous supply mechanism 16, which is a mechanism resembling a tape recorder. When the intense pulsed laser light is focused and directed onto the surface of the target, the substance of the target surface is evaporated by ablation, and this substance is dissociated by the electric field of the laser light so that a plasma 15 is generated. The radiation from this plasma 15 contains soft X-rays, so that this plasma can be utilized as a soft X-ray light source. Furthermore, since soft X-rays with a wavelength of 13 nm are attenuated by absorption in the air, the entire light path through which the soft X-rays pass is maintained in a vacuum.

In the present embodiment, a tape target-type laser plasma light source is used. However, the present invention is not limited to such a light source. It is also possible to use a plate-form or wire-form target, or a target in the form of a gas, liquid or fine particles, etc. Furthermore, it is also possible to use a discharge plasma light source or X-ray laser light source instead of a laser plasma light source.

The light beam generated by the laser plasma light source passes through the filter 17; then, after passing through a vacuum pipe 32, the light beam is focused by a focusing reflective mirror 11 installed inside a second vacuum chamber 31. The light beam then passes through the opening part 8 in the concave mirror 2 of the Schwarzschild optical system, and illuminates the surface of the sample 3. A multi-layer reflective film that reflects specified soft X-rays is formed on the surface of the focusing reflective mirror 11.

Soft X-rays of wavelengths other than the desired wavelength, as well as ultraviolet light and visible light, are also generated by the laser plasma light source. However, only soft X-rays of the desired wavelength are selected by the filter 17, the focusing reflective mirror 11 and the reflective mirrors with a multi-layer reflective film that constitutes the Schwarzschild optical system. In the present embodiment, in order to observe the sample with soft X-rays having a wavelength of 13 nm, Be (beryllium) is used for the filter 17, and a multi-layer film in which 50 layers of Mo (2.2 nm) and Si (4.5 nm) are alternately laminated (with the uppermost layer formed of Si) is used as the multi-layer reflective film. Be blocks visible light and ultraviolet light, but readily transmits soft X-rays on the long-wavelength side of the K absorption edge (11.1 nm) of Be. The multi-layer film of Mo/Si is well known as a material that shows a high reflectivity on the long-wavelength side of the L absorption edge (12.3 nm) of Si, and shows good reflection of soft X-rays having the desired wavelength of 13 nm.

The focusing reflective mirror 11, Schwarzschild optical system mirror tube 19 and sample stage 10, etc., are installed inside the second vacuum chamber 31. A vacuum evacuation system (not shown in the figures) constructed of a rotary pump and a cryopump is installed in each of the first vacuum chamber 30 and second vacuum chamber 31.

The illuminating light 5 that illuminates the sample 3 is reflected by the surface of the sample 3, and becomes reflected light 6. After being further reflected by the concave mirror 2 and convex mirror 1, which constitute the Schwarzschild optical system, his reflected light passes through the opening part 7 formed in the center of the concave mirror 2, and is focused on the image detector 4 to form an image.

The Schwarzschild optical system used in the present embodiment has a magnification of 100× and a numerical aperture (NA) of 0.12, and makes it possible to observe a visual field with a diameter of approximately 50 $\mu$m on the sample side (reduction side). An Mo/Si multi-layer film, which is used to reflect soft X-rays with a wavelength of 13 nm, is formed on the reflective surfaces of the respective reflective mirrors. Accordingly, this optical system has a resolution of 70 nm or finer.

In the present embodiment, a Schwarzschild optical system is used as the image-focusing optical system. However, the present invention is not limited to a Schwarzschild optical system in the narrowly defined sense, consisting of concentric spherical mirrors. The present invention can be applied to any image-focusing system having two mirrors, one concave and the other convex. For example, aspherical surface may be used in one of the concave and convex mirrors, or in both mirrors.

An opening part 8, which allows the illuminating light 5 to pass through, an opening part 7, which allows the reflected light reflected by the convex mirror 1 to pass through, and a diaphragm 9, are formed in the concave mirror 2 of the Schwarzschild optical system. The NA of the optical system is determined by this diaphragm 9. The diaphragm 9 is constructed by forming an Mo thin film with a thickness of 100 nm (leaving only the opening part) on the surface of the Mo/Si multi-layer film as described above. However, the material of the soft X-ray blocking film may be any material that is capable of blocking soft X-rays, and is not particularly limited to Mo. Alternatively, an Mo/Si multi-layer film may be formed only in the opening part of the diaphragm 9 to form the diaphragm 9.

Figure 6:
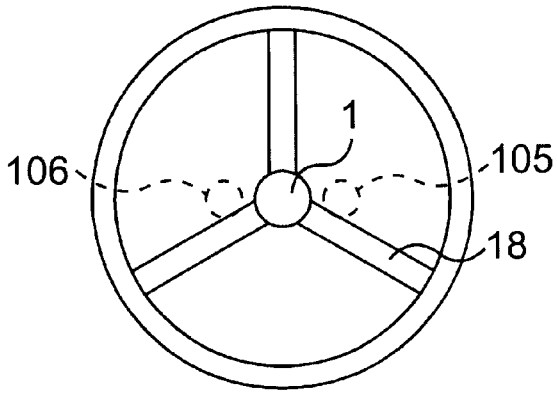
FIG. 6 illustrates a structure for supporting the convex mirror of the Schwarzschild optical system.

As shown in FIG. 6, the supporting columns 18 that support the convex mirror 1 of the Schwarzschild optical system are positioned in such a way as not to block the region 105 through which the illuminating light 5 passes or the region 106 through which the reflected light 6 reflected by the sample 3 passes. The concave mirror 2 and convex mirror 1 are fastened to the mirror tube 19 after the mutual positional relationship of the mirrors has been adjusted.

The sample stage 10 is an X-Y stage that is used to select the region of the sample 3 to be observed through moving the sample 3 within the plane. The maximum dimensions of the sample 3 that can be carried on the sample stage 10 are 230 mm×230 mm. The system is arranged so that any desired location on the surface of a sample 3 of these dimensions can be observed. Furthermore, although this is not shown in the figures, a sample conveying mechanism, which is used to reload samples without breaking the vacuum, is also provided.

A back-surface irradiation-type CCD (charge-coupled device), which is sensitive to soft X-rays, is used as the image detector 4.

A mechanism (selector) for switching the illuminating light from soft X-rays to visible light is also installed in the vacuum pipe 32 that connects the first vacuum chamber 30 and second vacuum chamber 31. The light beam emitted from a visible-light source 20 is introduced into the vacuum via a window 21, and is guided towards the focusing reflective mirror 11 by a reflective mirror 22. Furthermore, the reflective mirror 22 is provided with a mechanism for inserting the mirror 22 into the light path and for withdrawing the mirror from the light path, so that the light beam is not blocked when measurements are performed using soft X-rays. The focusing reflective mirror 11 and Schwarzschild optical system can also operate in the case of visible light, and the CCD used for soft X-rays is also sensitive to visible light. Accordingly, observation using soft X-rays and observation using visible light can be performed merely by switching the wavelength of the illuminating light.

Since visible light is also emitted from the laser plasma light source, this light source can also be utilized as a light source for visible-light observation. However, considering the consumption of the target, etc., it is more advantageous to switch light sources, as described above.

Reflective masks to be used in soft X-ray reduction projection exposure were inspected using the reflective-type soft X-ray microscope as constructed above. The wavelength used for the exposure of these reflective masks was the same (13 nm) as the observational wavelength of this reflective-type soft X-ray microscope. Observations were performed with both soft X-rays and visible light. The defects observed using visible light (missing portions and excess portions of the absorbing body pattern and bumps and dents in the surface of the multi-layer film) were all successfully observed using soft X-rays as well. Furthermore, even in the case where absolutely no abnormalities were recognized in multi-layer film surfaces under visible light, regions of clearly differing contrast were observed when the surfaces were examined with soft X-rays. Since the soft X-ray reflectivity differed in these areas, if these reflective masks are used in soft X-ray reduction projection exposure, images of these areas would be undesirably transferred on the wafer, producing pattern defects. These portions were examined using other higher-performance optical microscopes and scanning electron microscopes. However, the differences from other normal portions could not be discovered. Thus, the effectiveness of inspecting the reflective masks for defects using soft X-rays having the same wavelength as the exposure wavelength was demonstrated.

Here, soft X-rays with a wavelength of 13 nm were used in the present working example. However, the present invention is not limited to this wavelength. For example, in cases where soft X-rays with a wavelength of around 11 nm are used, an Mo/Be multi-layer film which affords a high reflectivity in this wavelength region may be used instead of an Mo/Si multi-layer film.

Furthermore, the above-mentioned embodiment was arranged so that a reflected image of the sample was observed in a bright-field view mode. However, it is also possible to perform observations using a dark-field view in which diffracted light or scattered light from the sample is focused as an image. In such a case, if a light-blocking part is installed in the position of the concave mirror shown in FIG. 2 at which the diaphragm 9 is installed in the case of a bright-field image, and a multi-layer reflective film is formed at the periphery of this light-blocking part, the remaining construction may be the same as in the above-mentioned embodiment. With this construction, the reflected light 6 is blocked by the light-blocking part, so that only the diffracted light or scattered light spread around the periphery of the reflected light 6 strikes the concave mirror 2 and contributes to imaging. The light-blocking part may be formed by forming a light-blocking film on the multi-layer reflective layer of the concave mirror 2. Alternatively, the system may be arranged so that the multi-layer reflective film is formed except this portion. As still another alternative, a light-blocking member may be installed in the light path between the sample 3 and the concave mirror 2.

Figure 7:
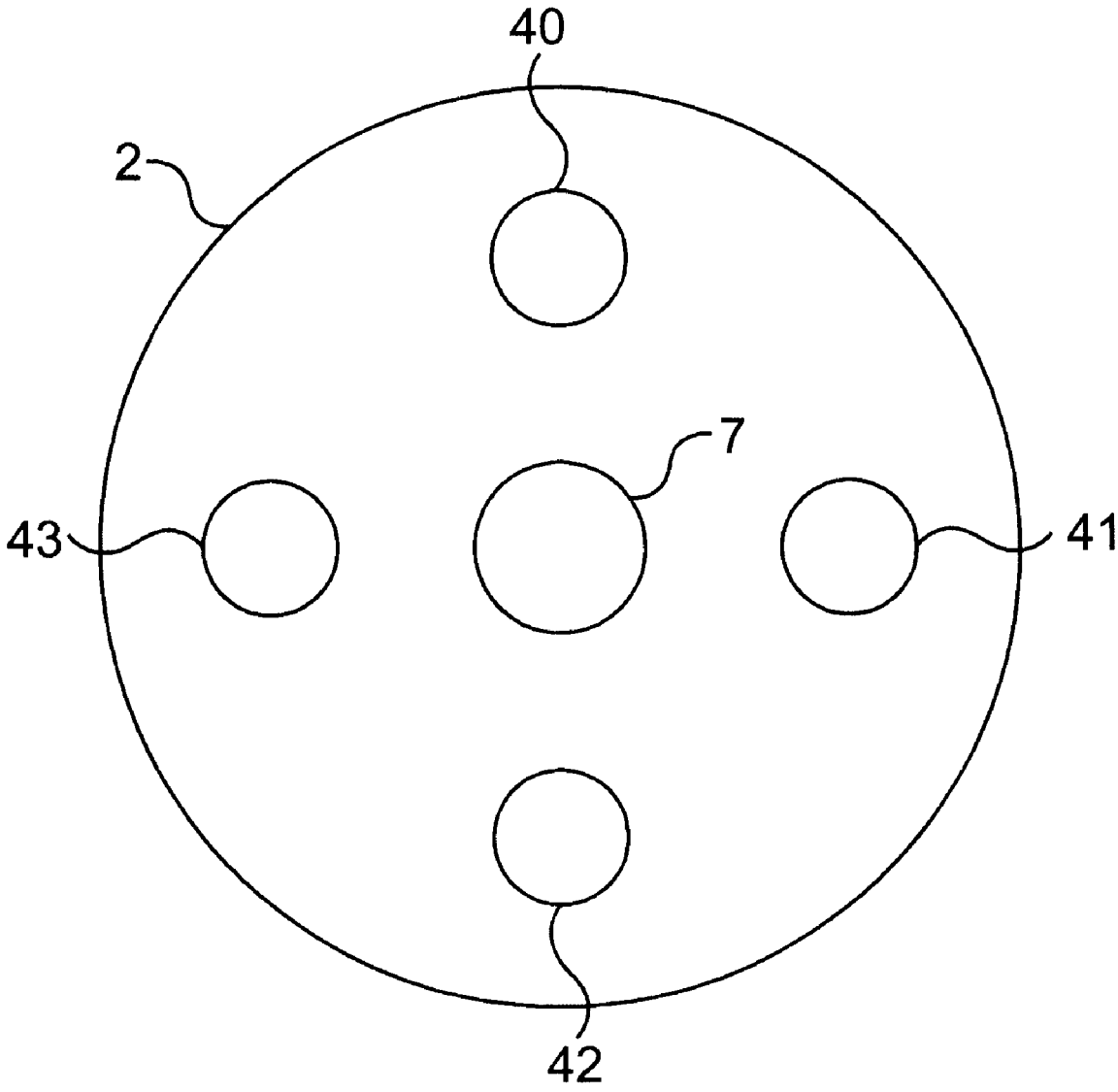
FIG. 7 illustrates the concave mirror of the Schwarzschild optical system according to a preferred embodiment of the present invention.

Furthermore, in the above-mentioned embodiment/working examples, an opening part was formed in only one location in the concave mirror of the Schwarzschild optical system; however, it would also be possible to form a plurality of opening parts in the concave mirror. FIG. 7 shows a concave mirror that has two opening parts. Soft X-rays are introduced via the opening part 40, and visible light or ultraviolet light is introduced via the other opening part 41. As a result of this arrangement, switching between soft X-rays of the observation wavelength and visible light or ultraviolet light is facilitated. Furthermore, it is also possible to observe the sample simultaneously with soft X-rays of different wavelengths by introducing soft X-rays of different wavelengths via the respective opening parts. In such a case, the system may be arranged so that multi-layer film reflective mirrors that reflect soft X-rays of the respective wavelengths are formed in the regions where the soft X-rays introduced via the respective opening parts strike the concave mirror after being reflected by the surface of the sample. In FIG. 7, for example, an Mo/Si multi-layer reflective film that reflects soft X-rays with a wavelength of 13 nm is formed in the region 42 where the soft X-rays introduced via the opening part 40 are incident on the concave mirror 2 after being reflected by the sample. Meanwhile, an Mo/Be multi-layer reflective film that reflects soft X-rays with a wavelength of 11 nm is formed in the region 43 where the soft X-rays introduced via the opening part 41 are incident on the concave mirror 2 after being reflected by the sample. If such a construction is used, reflective masks constructed for use at different wavelengths can be observed using a single image-focusing optical system. More specifically, in cases where the above-mentioned concave mirror 2 shown in FIG. 7 is used in the reflective-type soft X-ray microscope shown in FIG. 5, the system is arranged so that the illuminating light 5 is introduced via the opening part 40 when a reflective mask for use at a wavelength of 13 nm is to be observed. On the other hand, when a reflective mask for use at a wavelength of 11 nm is to be observed, the mirror tube 19 of the Schwarzschild optical system may be rotated about the optical axis so that the illuminating light 5 is introduced via the opening part 41.

In this case, the multi-layer reflective films in the regions where the respective reflected beams of soft X-rays strike the surface of the convex mirror are also formed by multi-layer films that reflect soft X-rays of the respective wavelengths. If necessary, furthermore, the wavelength of the soft X-rays can be varied by changing the target material of the laser plasma light source or replacing the focusing reflective mirror 11. If a heavy metal such as Ta, etc., is used as the target material of the laser plasma light source as in the embodiments above, soft X-rays will be radiated from this plasma across a broad wavelength range. Accordingly, if a totally reflective mirror with an inclined angle of incidence is used as the focusing reflective mirror 11 to illuminate soft X-rays having the broad wavelength range, there is no need to replace the target material or to replace the focusing reflective mirror 11. For example, a Kirkpatrick-Bays mirror or a Walter mirror, etc., can be used as such a focusing reflective mirror.

Furthermore, in cases where reflective masks are inspected using the reflective-type soft X-ray microscope of the present invention, the mask pattern region may have a size ranging from several tens of millimeters square to a hundred and several tens of millimeters square. However, the size of the visual field of the reflective-type soft X-ray microscope is at most several tens of microns. Accordingly, in cases where it is desired to obtain a soft X-ray image of the entire surface, a considerable amount of time is required in order to inspect a single mask. In the present invention, therefore, the measurement time is greatly shortened by scanning the surface of the sample while measuring the intensity of all soft X-rays entering the image-focusing optical system, instead of using soft X-ray images. The reason for this is that while a certain amount of accumulation time is required in order to obtain a soft X-ray image, the measurement time required is much shorter in the case of detecting only the intensity of the soft X-rays entering the visual field of the image-focusing optical system.

Here, when the reflective film is inspected prior to the formation of the light-blocking film, if the intensity of all soft X-rays entering the image-focusing optical system is measured while the surface of the reflective film is scanned, soft X-rays of a constant intensity will be detected if there are no defects in the reflective film. Here, if defects appear in the visual field, the detected intensity will vary. If such abnormalities in the detected intensity of the soft X-rays are detected, the positions and shapes of defects in the multi-layer film can be investigated by obtaining soft X-ray images at the positions of the abnormalities.

In cases where masks are inspected after the resist pattern or reflective or light-blocking pattern has been formed, if the overall intensity of the soft X-rays entering the image-focusing optical system is measured while the surface is scanned, the detected intensity will vary according to the relative fineness of the pattern even if there are no defects in the mask. Here, since the shape of the pattern on the mask is known, abnormalities in the pattern can be detected by calculating variations in the intensity of the soft X-rays caused by the pattern shape beforehand, and comparing the calculated values with measured values. If abnormalities are detected in this manner, the positions and shapes of respective pattern defects can be investigated by obtaining soft X-ray images at the positions of the abnormalities.

To construct a scanner performing these scanning operations, various software and hardware implementations are possible. Such a scanner may be constructed of a controller which controls the movement of the stage 10 in a scan manner and control the detection operation of the detector 4 in synchronization with the movement of the stage 10.

Furthermore, an image detector such as a CCD, etc., for obtaining soft X-ray images can also be used for measuring the overall intensity of the soft X-rays entering the image-focusing optical system of the soft X-ray microscope. Nonetheless, it is also possible to insert a detector, which has no spatial resolution, and which has a high intensity, such as a photodiode, etc., in front of the image detector. It is not necessary that such a detector used to measure intensity be positioned at the focal point of the image-focusing optical system. Accordingly, this detector can be positioned in an arbitrary space between the mirror tube 19 of the image-focusing optical system and the image detector 4. Furthermore, the system may be arranged so that the detector is inserted into the light path only when the overall intensity of the soft X-rays is to be measured, and is withdrawn from the light path when soft X-ray images are obtained.

In the reflective-type soft X-ray microscope of the present invention, as was described above, the sample surface is positioned to be substantially perpendicular to the optical axis of the image-focusing optical system, and reflected images and images based on scattered light or diffracted light can be observed. Accordingly, high-resolution observations over a broad visual field can be realized.

Furthermore, since the inspection of reflective masks for defects can be accomplished using soft X-rays of the same wavelength as the exposure wavelength, phase defects of multi-layer films, etc., which cannot be observed using conventional techniques, can be detected with high precision.

Moreover, in the reflective mask manufacturing method of the present invention, reflective mask defects that have been difficult to be discovered in the past can quickly be detected in the manufacturing process. Accordingly, the yield of reflective mask manufacture can be increased by correcting such detected defects.

It will be apparent to those skilled in the art that various modifications and variations can be made in the reflective-type soft X-ray microscope of the present invention without departing from the spirit or scope of the invention. Thus, it is intended that the present invention cover the modifications and variations of this invention provided they come within the scope of the appended claims and their equivalents.

What is claimed is:

1. A reflective-type soft X-ray microscope, comprising:

an image-focusing optical system including a concave mirror and a convex mirror;

an illumination optical system that has a light source, a filter, and a focusing optical element for transmitting a illumination light beam; and a stage mechanism that carries and moves a sample under observation, wherein the concave mirror has at least one opening part for transmitting the illuminating light beam that illuminates the sample and at least one other opening part for transmitting reflected light from the sample, and a reflected image of the sample is focused on a soft X-ray image detector by the image-focusing optical system.

2. The reflective-type soft X-ray microscope according to claim 1, wherein a surface of the sample is positioned to be substantially perpendicular to the optical axis of the image-focusing optical system.

3. The reflective-type soft X-ray microscope according to claim 1 or 2, wherein in the concave mirror of the image-focusing optical system, a diaphragm is installed in the position on which the illuminating light beam that has passed through the opening part is incident after being reflected by the sample.

4. The reflective-type soft X-ray microscope according to claim 3, wherein the diaphragm is formed by forming a light-blocking film on a reflective film formed on a surface of the concave mirror, while leaving an opening part that acts as a diaphragm.

5. The reflective-type soft X-ray microscope according to claim 3, wherein the diaphragm is formed by forming a reflective film only in an opening part that acts as said diaphragm.

6. The reflective-type soft X-ray microscope according to claim 3, wherein the diaphragm is disposed between the sample and the surface of the concave mirror, and is formed by one of a substrate made of a light-blocking material and a substrate covered by a light-blocking material, which has an opening part that acts as a diaphragm.

7. The reflective-type soft X-ray microscope according to claim 1 or 2, further comprising a supporting column for supporting the convex mirror of the image-focusing optical system, the supporting column being disposed such that neither the illuminating light beam illuminating the sample nor the reflected light beam reflected by the sample is blocked by the supporting column.

8. A reflective-type soft X-ray microscope, comprising:

an image-focusing optical system including a concave mirror and a convex mirror;

an illumination optical system including a light source, a filter and a focusing optical element for transmitting an illumination light beam; and a stage mechanism that carries and moves a sample under observation, wherein at least one opening part used to transmit the illuminating light beam that illuminates the sample is formed in the concave mirror, and at least one other opening part used to transmit scattered or diffracted light from the sample is formed in the concave mirror, an image of the sample formed by the scattered light or diffracted light being focused on a soft X-ray image detector by the image-focusing optical system.

9. The reflective-type soft X-ray microscope according to claim 8, wherein the surface of the sample is positioned to be substantially perpendicular to the optical axis of the image-focusing optical system.

10. The reflective-type soft X-ray microscope claimed in claim 8 or 9, wherein in the concave mirror of the image-focusing optical system, a reflective film is formed on a surface of the concave mirror, and a light-blocking film is formed of a substance that absorbs the reflected light beam only in the position on which the illuminating light beam that has passed through the opening part is incident after being scattered or diffracted by the sample.

11. The reflective-type soft X-ray microscope claimed in claim 8 or 9, wherein in the concave mirror of the image-focusing optical system, a reflective film is formed on the mirror except in the position on which the illuminating light beam that has passed through the opening part is incident after being scattered or diffracted by the sample.

12. The reflective-type soft X-ray microscope claimed in claim 8 or 9, wherein in the image-focusing optical system, one of a substrate made of a light-blocking material or a substrate covered by a light-blocking material is disposed between the concave mirror and the sample for blocking the scattered or diffracted light beam from the sample,.

13. The reflective-type soft X-ray microscope according to claim 8 or 9, further comprising a supporting column for supporting the convex mirror of the image-focusing optical system, the supporting column being disposed such that the illuminating light beam illuminating the sample is not blocked.

14. The reflective-type soft X-ray microscope according to claim 8 or 9, wherein the illumination optical system comprises:

a light source that is one of a laser plasma light source, a discharge plasma light source, and an X-ray laser light source;

a filter that selectively transmits soft X-rays of a specified wavelength; and a focusing optical element that focuses the light beam emitted from the light source.

15. The reflective-type soft X-ray microscope according to any one of claims 1, 2, 8, and 9, wherein the illumination optical system includes a selector that switches the illuminating light to one of soft X-rays, visible light and ultraviolet light.

16. The reflective-type soft X-ray microscope according to any one of claims 1, 2, 8, and 9, wherein a plurality of the illumination optical systems are installed, and a plurality of illuminating light beams that have different wavelengths are respectively caused to be incident on the sample via a plurality of different opening parts formed in the concave mirror of the image-focusing optical system.

17. The reflective-type soft X-ray microscope according to any one of claims 1, 2, 8, and 9, wherein the image-focusing optical system is a Schwarzschild optical system.

18. A mask inspection device for inspecting a reflective mask to be used in a soft X-ray reduction projection exposure, comprising the reflective-type soft X-ray microscope of any one of claims 1, 2, 8, and 9 using soft X-rays having the same wavelength as that to be used in the soft X-ray reduction projection exposure.

19. A mask inspection device for inspecting a reflective mask to be used in a soft X-ray reduction projection exposure, comprising:

the reflective-type soft X-ray microscope of any one of claims 1, 2, 8, and 9 using soft X-rays having the same wavelength as that to be used in the soft X-ray reduction projection exposure; and a scanner that causes the surface of the sample to be scanned while the intensity of reflected light, diffracted light or scattered light is detected, the scanner further causing an image to be acquired in areas where the detected intensity varies.

20. A method for manufacturing a reflective mask having a pattern on a substrate, the method comprising:

a first step of forming a reflective film having a multilayer film for reflecting soft X-rays on a substrate;

a second step of forming a light-blocking film that absorbs soft X-rays on the reflective film;

a third step of forming a resist layer on the light-blocking film;

a fourth step of exposing portions of the resist layer for forming a latent image corresponding to a desired reflective or light-blocking pattern in the resist layer;

a fifth step of developing the resist layer to form the desired reflective or light-blocking pattern; and a sixth step of etching the light-blocking film using the developed resist layer as a protective layer, wherein at least one of the first, fifth, and sixth steps includes the step of inspecting the reflective film, the light-blocking film, the resist layer, or the reflective or light-blocking pattern formed in the resist layer or the reflective mask using the mask inspection device of claim 19.

21. A method for manufacturing a reflective mask having a pattern on a substrate, the method comprising:

a first step of forming a reflective film having a multilayer film for reflecting soft X-rays on a substrate;

a second step of forming a resist layer on the reflective film;

a third step of exposing portions of the resist layer to form a latent image corresponding to a reflective or light-blocking pattern in the resist layer;

a fourth step of developing the resist layer to form the reflective or light-blocking pattern; and a fifth step of forming a light-blocking film formed of one of an inorganic compound, an organic compound, and an organic and inorganic compound, which absorbs soft X-rays in areas not covered by the developed resist layer, using the resist layer as a protective layer, wherein at least one of the first, fourth, and fifth steps includes the step of inspecting the reflective film, the light-blocking film or the reflective or light-blocking pattern formed in the resist layer or the reflective mask using the mask inspection device of claim 19.

22. A reflective-type soft X-ray microscope, comprising:

an image-focusing optical system including a concave mirror and a convex mirror;

an illumination optical system that has a light source, a filter, and a focusing optical element for transmitting an illumination light beam; and a stage mechanism that carries and moves a sample under observation, wherein the concave mirror has at least one opening part for transmitting the illuminating light beam that illuminates the sample, and a reflected image of the sample is focused on a soft X-ray image detector by the image-focusing optical system, and wherein in the concave mirror of the image-focusing optical system, a diaphragm is installed in the position on which the illuminating light beam that has passed through the opening part is incident after being reflected by the sample.

23. The reflective-type soft X-ray microscope according to claim 22, wherein a surface of the sample is positioned to be substantially perpendicular to the optical axis of the image-focusing optical system.

24. The reflective-type soft X-ray microscope according to claim 22 or 23, wherein the diaphragm is formed by forming a light-blocking film on a reflective film formed on a surface of the concave mirror, while leaving an opening part that acts as a diaphragm.

25. The reflective-type soft X-ray microscope according to claim 22 or 23, wherein the diaphragm is formed by forming a reflective film only in an opening part that acts as said diaphragm.

26. The reflective-type soft X-ray microscope according to claim 22 or 23, wherein the diaphragm is disposed between the sample and the surface of the concave mirror, and is formed by one of a substrate made of a light-blocking material and a substrate covered by a light-blocking material, which has an opening part that acts as a diaphragm.

27. A reflective-type soft X-ray microscope, comprising:

an image-focusing optical system including a concave mirror and a convex mirror;

an illumination optical system including a light source, a filter and a focusing optical element for transmitting an illumination light beam; and a stage mechanism that carries and moves a sample under observation, wherein at least one opening part used to transmit the illuminating light beam that illuminates the sample is formed in the concave mirror, and an image formed by scattered light or diffracted light is focused on a soft X-ray image detector by the image-focusing optical system, and wherein in the concave mirror of the image-focusing optical system, a reflective film is formed on a surface of the concave mirror, and a light-blocking film is formed of a substance that absorbs the reflected light beam only in the position on which the illuminating light beam that has passed through the opening part is incident after being scattered or diffracted by the sample.

28. The reflective-type soft X-ray microscope according to claim 27, wherein the surface of the sample is positioned to be substantially perpendicular to the optical axis of the image-focusing optical system.

29. A reflective-type soft X-ray microscope, comprising:

an image-focusing optical system including a concave mirror and a convex mirror;

an illumination optical system including a light source, a filter and a focusing optical element for transmitting an illumination light beam; and a stage mechanism that carries and moves a sample under observation, wherein at least one opening part used to transmit the illuminating light beam that illuminates the sample is formed in the concave mirror, and an image formed by scattered light or diffracted light is focused on a soft X-ray image detector by the image-focusing optical system, and wherein in the concave mirror of the image-focusing optical system, a reflective film is formed on the mirror except in the position on which the illuminating light beam that has passed through the opening part is incident after being scattered or diffracted by the sample.

30. The reflective-type soft X-ray microscope according to claim 29, wherein the surface of the sample is positioned to be substantially perpendicular to the optical axis of the image-focusing optical system.

31. A reflective-type soft X-ray microscope, comprising:

an image-focusing optical system including a concave mirror and a convex mirror;

an illumination optical system including a light source, a filter and a focusing optical element for transmitting an illumination light beam; and a stage mechanism that carries and moves a sample under observation, wherein at least one opening part used to transmit the illuminating light beam that illuminates the sample is formed in the concave mirror, and an image formed by scattered light or diffracted light is focused on a soft X-ray image detector by the image-focusing optical system, and wherein in the image-focusing optical system, one of a substrate made of a light-blocking material or a substrate covered by a light-blocking material is disposed between the concave mirror and the sample for blocking the scattered or diffracted light beam from the sample.

32. The reflective-type soft X-ray microscope according to claim 31, wherein the surface of the sample is positioned to be substantially perpendicular to the optical axis of the image-focusing optical system.

33. A reflective-type soft X-ray microscope, comprising:

an image-focusing optical system including a concave mirror and a convex mirror;

an illumination optical system that has a light source, a filter, and a focusing optical element for transmitting an illumination light beam; and a stage mechanism that carries and moves a sample under observation, wherein the concave mirror has at least one opening part for transmitting the illuminating light beam that illuminates the sample, and a reflected image of the sample is focused on a soft X-ray image detector by the image-focusing optical system, and wherein a plurality of the illumination optical systems are installed, and a plurality of illuminating light beams that have different wavelengths are respectively caused to be incident on the sample via a plurality of different opening parts formed in the concave mirror of the image-focusing optical system.

34. The reflective-type soft X-ray microscope according to claim 33, wherein a surface of the sample is positioned to be substantially perpendicular to the optical axis of the image-focusing optical system.

35. A reflective-type soft X-ray microscope, comprising:

an image-focusing optical system including a concave mirror and a convex mirror;

an illumination optical system including a light source, a filter and a focusing optical element for transmitting an illumination light beam; and a stage mechanism that carries and moves a sample under observation, wherein at least one opening part used to transmit the illuminating light beam that illuminates the sample is formed in the concave mirror, and an image formed by scattered light or diffracted light is focused on a soft X-ray image detector by the image-focusing optical system, wherein a plurality of the illumination optical systems are installed, and a plurality of illuminating light beams that have different wavelengths are respectively caused to be incident on the sample via a plurality of different opening parts formed in the concave mirror of the image-focusing optical system.

36. The reflective-type soft X-ray microscope according to claim 35, wherein the surface of the sample is positioned to be substantially perpendicular to the optical axis of the image-focusing optical system.

37. A mask inspection device for inspecting a reflective mask to be used in a soft X-ray reduction projection exposure, comprising:

a reflective-type soft X-ray microscope using soft X-rays having the same wavelength as that to be used in the soft X-ray reduction projection exposure, the reflective-type soft X-ray microscope comprising:

an image-focusing optical system including a concave mirror and a convex mirror;

an illumination optical system that has a light source, a filter, and a focusing optical element for transmitting an illumination light beam; and a stage mechanism that carries and moves a sample under observation, wherein the concave mirror has at least one opening part for transmitting the illuminating light beam that illuminates the sample, and a reflected image of the sample is focused on a soft X-ray image detector by the image-focusing optical system; and a scanner that causes the surface of the sample to be scanned while the intensity of reflected light, diffracted light or scattered light is detected, the scanner further causing an image to be acquired in areas where the detected intensity varies.

38. The mask inspection device according to claim 37, wherein the surface of the sample is positioned to be substantially perpendicular to the optical axis of the image-focusing optical system.

39. A mask inspection device for inspecting a reflective mask to be used in a soft X-ray reduction projection exposure, comprising:

a reflective-type soft X-ray microscope using soft X-rays having the same wavelength as that to be used in the soft X-ray reduction projection exposure, the reflective-type soft X-ray microscope comprising:

an image-focusing optical system including a concave mirror and a convex mirror;

an illumination optical system including a light source, a filter and a focusing optical element for transmitting an illumination light beam; and a stage mechanism that carries and moves a sample under observation, wherein at least one opening part used to transmit the illuminating light beam that illuminates the sample is formed in the concave mirror, and an image formed by scattered light or diffracted light is focused on a soft X-ray image detector by the image-focusing optical system; and a scanner that causes the surface of the sample to be scanned while the intensity of reflected light, diffracted light or scattered light is detected, the scanner further causing an image to be acquired in areas where the detected intensity varies.

40. The mask inspection device according to claim 39, wherein the surface of the sample is positioned to be substantially perpendicular to the optical axis of the image-focusing optical system.

41. A method for manufacturing a reflective mask having a pattern on a substrate, the method comprising:

a first step of forming a reflective film having a multi-layer film for reflecting soft X-rays on a substrate;

a second step of forming a light-blocking film that absorbs soft X-rays on the reflective film;

a third step of forming a resist layer on the light-blocking film;

a fourth step of exposing portions of the resist layer for forming a latent image corresponding to a desired reflective or light-blocking pattern in the resist layer;

a fifth step of developing the resist layer to form the desired reflective or light-blocking pattern; and a sixth step of etching the light-blocking film using the developed resist layer as a protective layer, wherein at least one of the first, fifth, and sixth steps includes the step of inspecting the reflective film, the light-blocking film, the resist layer, or the reflective or light-blocking pattern formed in the resist layer or the reflective mask using the mask inspection device of any one of claims 37, 38, 39, and 40.

42. A method for manufacturing a reflective mask having a pattern on a substrate, the method comprising:

a first step of forming a reflective film having a multi-layer film for reflecting soft X-rays on a substrate;

a second step of forming a resist layer on the reflective film;

a third step of exposing portions of the resist layer to form a latent image corresponding to a reflective or light-blocking pattern in the resist layer;

a fourth step of developing the resist layer to form the reflective or light-blocking pattern; and a fifth step of forming a light-blocking film formed of one of an inorganic compound, an organic compound, and an organic and inorganic compound, which absorbs soft X-rays in areas not covered by the developed resist layer, using the resist layer as a protective layer, wherein at least one of the first, fourth, and fifth steps includes the step of inspecting the reflective film, the light-blocking film or the reflective or light-blocking pattern formed in the resist layer or the reflective mask using the mask inspection device of any one of claims 37, 38, 39, and 40.

* * * * *